US006289647B1

(12) United States Patent
Sjölander

(10) Patent No.: US 6,289,647 B1
(45) Date of Patent: Sep. 18, 2001

(54) WALL FACING SYSTEM

(76) Inventor: Oliver Sjölander, Hjortstigen 24, S-731 43 Köping (SE)

( * ) Notice: Subject to any disclaimer, the term of this patent is extended or adjusted under 35 U.S.C. 154(b) by 0 days.

(21) Appl. No.: 09/529,299

(22) PCT Filed: Oct. 28, 1998

(86) PCT No.: PCT/SE98/01954

§ 371 Date: Apr. 12, 2000

§ 102(e) Date: Apr. 12, 2000

(87) PCT Pub. No.: WO99/22087

PCT Pub. Date: Jun. 5, 1999

(30) Foreign Application Priority Data

Oct. 29, 1997 (SE) ..... 9703954

(51) Int. Cl.[7] ..... E04F 13/08; E04B 2/96

(52) U.S. Cl. ..... 52/510; 52/506.05; 52/386; 52/482

(58) Field of Search ..... 52/506.05, 510, 52/551, 513, 482, 384, 385, 386, 387

(56) References Cited

U.S. PATENT DOCUMENTS

| | | | | |
|---|---|---|---|---|
| 1,661,750 | * | 3/1928 | Dunbar | 52/510 X |
| 1,707,347 | | 4/1929 | Dunbar . | |
| 1,732,620 | | 10/1929 | Schubert . | |
| 2,066,268 | * | 12/1936 | Hohner | 52/510 X |
| 4,134,244 | * | 1/1979 | Sjolander | 52/506.1 |
| 4,803,821 | * | 2/1989 | Funaki | 52/387 |
| 4,856,245 | * | 8/1989 | Osawa | 52/386 |
| 4,890,433 | * | 1/1990 | Funaki | 52/510 X |
| 5,029,425 | * | 7/1991 | Bogataj | 52/482 |
| 5,390,457 | * | 2/1995 | Sjolander | 52/482 X |

FOREIGN PATENT DOCUMENTS

| | | | | |
|---|---|---|---|---|
| 2125082 | * | 2/1984 | (GB) | 52/386 |
| 2-311656 | * | 12/1990 | (JP) | 52/384 |
| 4-174158 | * | 6/1992 | (JP) | 52/384 |
| 4-174160 | * | 6/1992 | (JP) | 52/384 |
| 321068 | * | 2/1970 | (SE) | 52/386 |
| 324 446 | | 6/1970 | (SE) . | |

* cited by examiner

*Primary Examiner*—Laura A. Callo
(74) *Attorney, Agent, or Firm*—Browdy and Neimark

(57) ABSTRACT

A wall facing system including elongate wall facing tiles (15) of stone material and mounting bars (11) adapted to be secured in a vertical position on a building wall to support the tiles (15) with the tiles positioned one above the other and having their longitudinal dimension horizontal, and with vertically adjacent tiles adjacent and, optionally, overlapping one another. Each facing tile (15) has on its front side a rebate (15A), which extends along the upper edge of the tile, and a front plate, which extends from the rebate down to the lower edge of the tile. Moreover, each facing tile (15) has on its rear side a downwardly projecting support rib (15E), which extends in parallel with the upper and lower edges of the tile. Each mounting bar (11) has at least one flange (12) which extends in the longitudinal direction of the mounting bar and is provided with a plurality of support hooks (13) evenly spaced-apart in the longitudinal direction of the mounting bar and adapted to engage the support ribs (15E) of the tiles (15) from below to support the tiles. The lower edge of the support rib (15E) is spaced from the upper edge of the tile (15) by a distance which is not more than about 0.4, and preferably not more than about 0.3 times the total height of the tile, and each support hook (13) has a front edge defined by the front edge (12A) of the flange (12) and serving as a lateral support for a tile (15) supported by it, the length of the front edge of the support hook being at least half the distance separating corresponding points on adjacent support hooks.

3 Claims, 2 Drawing Sheets

WALL FACING SYSTEM

CROSS REFERENCE TO RELATED APPLICATION

The present application is the national stage under 35 U.S.C. 371 of PCT/SE98/01954, filed Oct. 28 1998.

This invention relates to wall facing systems of the type including horizontally elongate facing plates of stone material supported by mounting bars adapted to be secured in a vertical position on a building wall. More particularly, the invention relates to a wall facing system of the kind set forth in the precharacterizing portion of the independent claim.

A wall facing system of that kind is known from, for example, W092/08857.

In an embodiment of the prior art system which is now available on the market, the length of the facing plates or tiles is 300 mm, alternatively 600 mm, and their height (width) and thickness are respectively 100 mm and 30 mm. They are artificial stones made from granular marble, cement and pigment.

As will be readily appreciated, the facing tiles have a considerable weight. Because of the weight, on the order of 50 kg per square meter of faced wall surface, the costs for transporting the tiles from the manufacturing site to the building site amount to a substantial percentage of the total cost for the facing, especially if the tiles have to be transported over a long distance.

Because of the high costs of transportation it is hardly economically feasible to export the tiles, possibly with the exception of nearby export markets. In certain cases, even the costs for domestic transports may make the system economically unacceptable.

Given the nature of the material of the tiles, a reduction of the thickness of the tiles offers the only possibility of reducing the weight of the tiles. However, a reduction of the thickness is not readily feasible, because the manner of mounting the tiles on the wall necessitates a certain minimum tile thickness, in order that the strength of the plates may not be inadequate. Although it would be possible to reduce the weight by making the thinned lower part of the front portion of the tiles higher (wider) and correspondingly reducing the height (width) of the rear tile portion, the increased height of the lower part of the front portion would substantially increase the danger of damaging the tiles. In addition, the surface by which the rear side of the mounting part of the tiles, i.e. the portion of the rear face of the tiles which is above the support rib, engages the mounting bar, would be smaller (narrower), so that the plate would not firmly engage the mounting bars.

The present invention provides a solution whereby the weight of the tiles may be substantially reduced, by up to about 50 percent, by reducing the thickness of the tile over a substantial portion of the height of the tile, while at the same time balancing the consequent reduction of the strength of the tile by improving the support provided for that thinned tile portion by the mounting bars.

Figure 1:
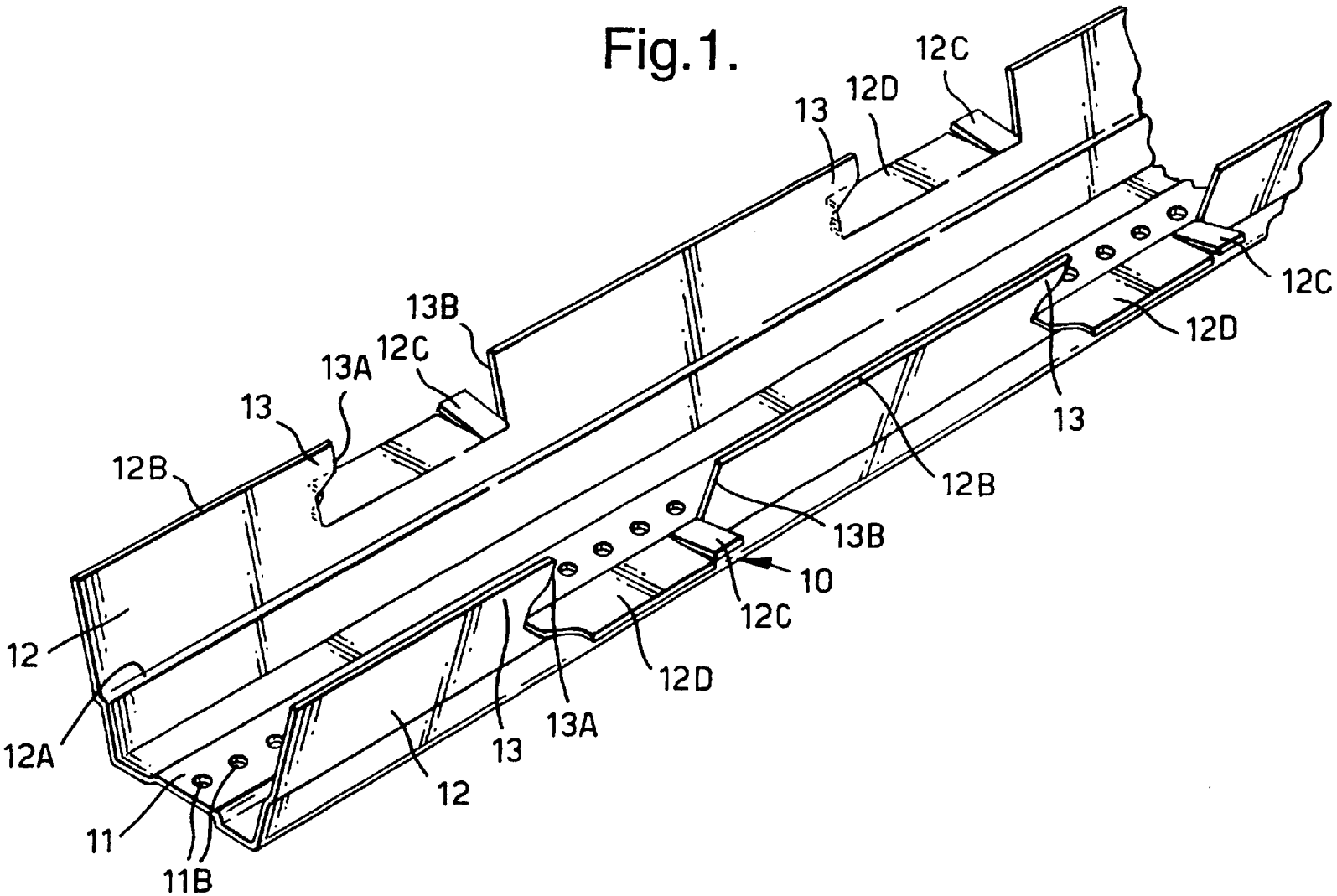
Figure 2:
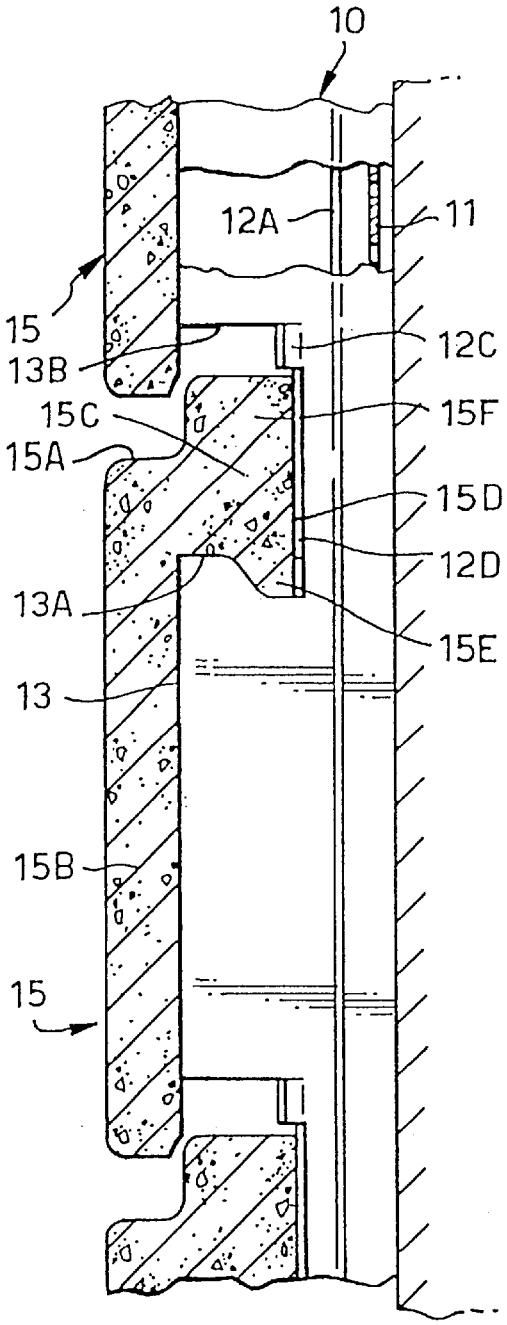
Figure 3:
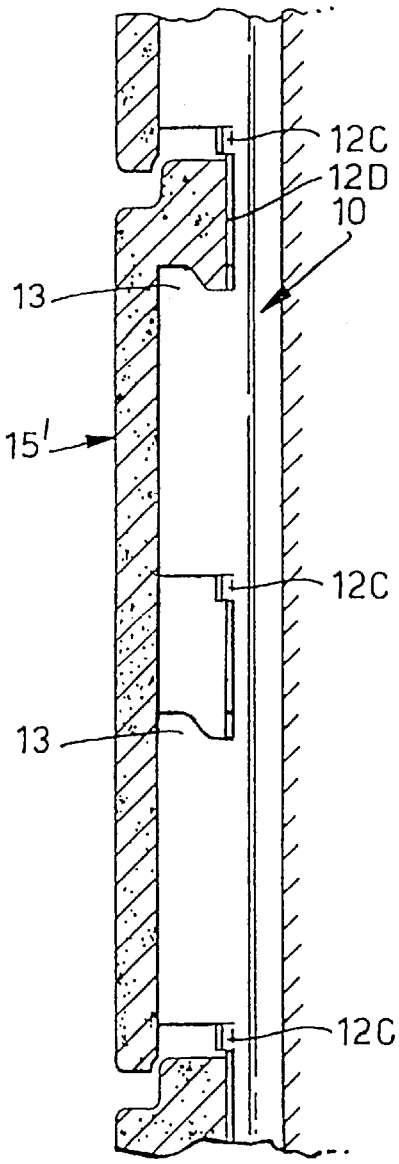

The invention will be explained more fully below with reference to the annexed drawing, in which:

FIG. 1 is a perspective view of a mounting bar of the wall facing system according to the invention;

FIG. 2 a diagrammatic vertical sectional view of the wall facing system according to the invention;

FIG. 3 is a diagrammatic sectional view of a modification of the wall facing system of FIG. 1.

The mounting bar shown in FIG. 1 is similar to the mounting bar of the above-mentioned prior art system insofar as it is a straight sheet-metal profile bar having a generally flat web 11 of constant width and a pair of diverging flanges 12 which extend from opposite longitudinal marginal portions of the web and include a plurality of evenly spaced-apart pairs of support hooks 13—the two hooks in each pair being positioned opposite to one another across the width of the support bar—adapted to support the facing tiles of the facing system; these tiles are shown in cross-section in FIGS. 2 and 3 and will be described below.

The mounting bar 10 is symmetrical with respect to a longitudinal centre plane which is normal to the main plane of the web 11 of the mounting bar 10 and contains the longitudinal centre line of the web. The central portion of the web 11 is slightly raised and provided with a plurality of apertures 11B for screws by which the mounting bar 10 can be secured in a vertical position on a building to be provided with the facing.

Approximately halfway between the web 11 of the mounting bar and the free or outer flange edge 12B, each flange 12 has a stiffening intermediate portion 12A which is generally parallel to the main plane of the web. Accordingly, the outer portion of each flange is offset laterally outwardly from the inner portion, but parallel to the latter.

The support hooks 13 have been formed by making incisions from the free or outer edge 12B of each flange 12 at the locations where the upper edge 13A and the lower edge 13B of each support hook are to be located and bending the flange portions 12C and 12D between the incisions outwardly, such that one of these flange portions, the one designated 12C, is at an acute angle to the web 11, while the outer flange portion 12D is parallel to the web.

As best shown in FIGS. 2 and 3, the upper edge 13A of each support hook 13 is curved to define an upwardly open recess for the reception of a downwardly projecting support rib of the facing tile (to be described below) supported by the support hook. The lower edge 13B is substantially straight and perpendicular to the longitudinal centre line of the mounting bar 10.

In accordance with the invention, the length of the section of the free edge of the flanges 12 which is subtended by the support hooks 13 is a substantial portion, at least one-half and preferably more—in the illustrated exemplary embodiment about 70 percent—of the distance separating corresponding parts, e.g. the lower edges 13B, of adjacent support hooks 13 on the same flange 12. Thus, the height of the open space between adjacent support hooks 13 preferably is less than about one-half, in the illustrated example about 30 percent, of the just-mentioned distance.

FIG. 2 shows the facing tile, generally designated by 15, as viewed in cross-section. As in the prior art system the facing tile, when viewed from the front, is elongate and rectangular—length 300 mm, for example, and height 100 mm, for example—the longitudinal edges being horizontal when the tile is supported on the mounting bars.

Generally speaking, the shape of the facing tile 15 is the same as the shape of the facing tile of the prior art system. Accordingly, on its front side, the left side in FIG. 2, the upper portion of the tile has a rebate 15A extending along the upper edge of the tile. The major portion of the front side of the tile is formed by a flat portion of substantially constant thickness. This portion is here referred to as the front plate and designated by 15B.

At its upper portion the front plate 15B merges with a rib-like mounting part 15C which projects rearwardly from the front plate 15B and has a rear side 15D which is parallel to the front and rear sides of the front plate.

The lower portion of the mounting part 15C is undercut and forms a downwardly projection support rib 15E, the cross-sectional shape of which is matched with the shape of the upper edge 13B of the support hooks 13 of the mounting bar 10. At its upper portion, the mounting part 15C forms a rib 15F which projects upwardly from the horizontal bottom surface of the rebate 15A and the front face of which constitutes the vertical wall of the rebate. The thickness of the mounting part 15C as measured between the rear face of the front plate 15B and the rear face 15D of the mounting part 15C, corresponds to the distance between the outer edge 12B of the flanges 12 and the front face of the outwardly folded flange portions 12D. In the region of the upstanding ridge 15F the thickness may be the same or slightly different.

As shown in FIG. 2, the mounting part 15C only subtends a relatively small portion of the overall height of the tile; preferably, the overall height of the mounting part is not more than about 0.4 times the overall height of the tile, and more preferably it is not more than about one-third of that height. In the illustrated example, the height of the mounting part is slightly less than 0.3 times the height of the tile. Preferably, the height of the portion of the tile extending downwardly from the mounting part, that is, the height of the front plate 15B, is at least about 60 percent, and more preferably at least about 70 percent of the overall height of the tile.

When mounting a facing tile 15 on the mounting bars 11 the mounting part 15C is inserted in the gap between adjacent support hooks 13 so that the tile can be hooked to the lower support hook 13. It may then be necessary to displace the upper, forwardly projecting flange portion 12C inwardly by pressing the tile inwardly. When the tile has been properly positioned, this flange portion 12C will spring back forwardly to prevent raising of the tile.

In the illustrated embodiment the mounted tiles overlap slightly. If desired, the lower end portion of the front plate 15B may engage the upwardly projecting rib 15F of the adjacent underlying tile.

As shown in FIG. 2, the great height of the vertical outer edge of the support hooks 13 ensures a firm support of the tile 15 substantially throughout the height of the front plate. At the same time, the rear surface 15D of the mounting part 15C is firmly supported by the outwardly folded flange portions 12D. The entire tile 15 is firmly engaged with the mounting bar 10 because of the cooperation between the support hooks 13 and the support rib 15E.

The front plate 15B can therefore have the reduced thickness over the major portion of its height as shown and still, because of the firm support against the mounting bar 10, notably the front edge of the support hooks 13, withstand substantial mechanical loads.

Because the weight of the tiles 15 is thus substantially reduced, by up to about 50 percent of the weight of the prior art tiles, the costs of transporting the tiles are substantially reduced, and the consumption of material is also reduced in proportion to the weight reduction. In addition, because of the reduced tile weight and the stiffening intermediate portions 12C, the mounting bars may be made from thinner sheet metal. The manual labour associated with the mounting of the tiles also requires less effort.

As shown in FIG. 3, the illustrated mounting bar 10 may also be used for facing tiles 15' of a height twice that of the tile 15 shown in FIG. 2 without any modification of the mounting bar being required. The facing tile 15' is also supported by the front edge of the support hooks 13 over the major portion of the height of the front plate.

What is claimed is:

1. A wall facing system including elongate wall facing tiles (15) of stone material and mounting bars (10) adapted to be secured in a vertical position on a building wall to support the tiles (15) with the tiles positioned one above the other and having their longitudinal dimension horizontal, and with vertically adjacent tiles adjacent and, optionally, overlapping one another, each facing tile (15) having on its front side a rebate (15A), which extends along the upper edge of the tile, and a front plate, which extends from the rebate down to the lower edge of the tile, and having on its rear side a downwardly projecting support rib (15E), which extends in parallel with the upper and lower edges of the tile, and each mounting bar (10) having at least one flange (12) which extends in the longitudinal direction of the mounting bar and is provided with a plurality of support hooks (13) evenly spaced-apart in the longitudinal direction of the mounting bar and adapted to engage the support ribs (15E) of the tiles (15) from below to support the tiles, characterised in that the lower edge of the support rib (15E) is spaced from the upper edge of the tile (15) by a distance which is not more than about 0.4 times the total height of the tile, and each support hook (13) having a front edge defined by the front edge (12A) of the flange (12) and serving as a lateral support for a tile (15) supported by it, the length of the front edge of the support hook (13) being at least half the distance separating corresponding points on adjacent support hooks.

2. A wall facing system according to claim 1, in which the height of each tile (15') is approximately equal to twice the distance separating adjacent support hooks (13) of the mounting bar (10).

3. A wall facing system according to claim 1, wherein the lower edge of the support rib (15E) is spaced from the upper edge of the tile (15) by a distance which is not more than about 0.3 times the total height of the tile.

* * * * *